US008393913B2

(12) United States Patent
Wu

(10) Patent No.: US 8,393,913 B2
(45) Date of Patent: Mar. 12, 2013

(54) ELECTRICAL CONNECTOR ASSEMBLY WTH LATCH MECHANISM EASILY OPERATED

(75) Inventor: Jerry Wu, Irvine, CA (US)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 0 days.

(21) Appl. No.: 13/155,406

(22) Filed: Jun. 8, 2011

(65) Prior Publication Data

US 2011/0300735 A1 Dec. 8, 2011

(30) Foreign Application Priority Data

Jun. 8, 2010 (CN) ..... 2010 2 0219027 U

(51) Int. Cl.
*H01R 4/50* (2006.01)

(52) U.S. Cl. ..... 439/345

(58) Field of Classification Search ..... 439/345, 439/352, 483

See application file for complete search history.

(56) References Cited

U.S. PATENT DOCUMENTS

| | | | | |
|---|---|---|---|---|
| 6,168,473 | B1 * | 1/2001 | Hsin | 439/676 |
| 6,443,751 | B1 * | 9/2002 | Pan | 439/342 |
| 7,001,194 | B2 * | 2/2006 | Yang et al. | 439/295 |
| 7,056,138 | B2 * | 6/2006 | Lewis et al. | 439/296 |
| 7,134,914 | B1 * | 11/2006 | Wu | 439/607.41 |
| 7,189,013 | B2 * | 3/2007 | Yang et al. | 385/92 |
| 7,281,937 | B2 * | 10/2007 | Reed et al. | 439/352 |
| 7,581,978 | B1 * | 9/2009 | Briant | 439/358 |
| 7,643,720 | B2 * | 1/2010 | Kim et al. | 385/134 |
| 7,651,359 | B2 * | 1/2010 | Scherer et al. | 439/345 |
| 7,666,023 | B2 * | 2/2010 | Wu | 439/352 |
| 7,828,579 | B2 * | 11/2010 | Huang | 439/352 |
| 7,938,669 | B2 * | 5/2011 | Li et al. | 439/352 |
| 7,997,920 | B1 * | 8/2011 | Sun et al. | 439/345 |
| 8,062,049 | B2 * | 11/2011 | Tobey | 439/345 |
| 8,152,555 | B2 * | 4/2012 | Wu | 439/352 |
| 2011/0183535 | A1 * | 7/2011 | Wu | 439/153 |
| 2011/0281455 | A1 * | 11/2011 | Wu | 439/345 |

* cited by examiner

*Primary Examiner* — Amy Cohen Johnson

*Assistant Examiner* — Vladimir Imas

(74) *Attorney, Agent, or Firm* — Wei Te Chung; Ming Chieh Chang

(57) ABSTRACT

An electrical connector assembly (100), comprises: a housing (1) having therein two receiving rooms (11) extending along a front-to-rear direction and communicating with an exterior. Four printed circuit boards (2) received into two receiving rooms and positioned in the housing. A latch mechanism assembled to an exterior surface of the housing. And, a metallic holder interlocked with the housing and shielding a portion of the latch mechanism.

19 Claims, 14 Drawing Sheets

ELECTRICAL CONNECTOR ASSEMBLY WTH LATCH MECHANISM EASILY OPERATED

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

And, I/O connector will has a developing trend to form multi-ports on a front end thereof to meet more and more higher data transmitting rate requirements of the server. As a result, a width of the electrical connector becomes larger. Thus, a latch formed on the electrical connector will be difficult to operate to achieve an engagement and disengagement between the I/O connector and the complementary connector.

As discussed above, an improved electrical connector overcoming the shortages of existing technology is needed.

SUMMARY OF THE INVENTION

Accordingly, an object of the present invention is to provide an electrical connector assembly with a latch mechanism easily operated.

In order to achieve the above-mentioned objects, an electrical connector assembly, comprises: a housing having therein two receiving rooms extending along a front-to-rear direction and communicating with an exterior; four printed circuit boards received into two receiving rooms and positioned in the housing; a latch mechanism assembled to an exterior surface of the housing; and a metallic holder interlocked with the housing and shielding a portion of the latch mechanism.

Other objects, features and advantages of the invention will be apparent from the following detailed description taken in connection with the accompanying drawings.

DETAILED DESCRIPTION OF PREFERRED EMBODIMENTS

Figure 1:
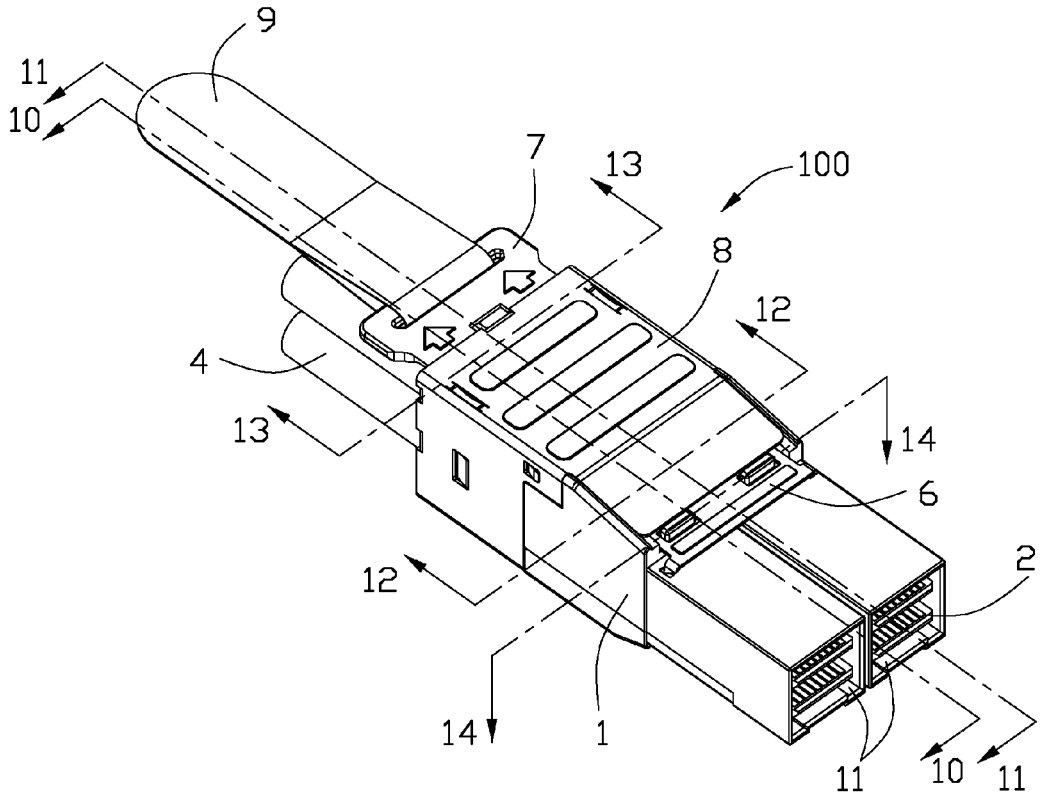
FIG. 1 is a perspective view of an electrical connector assembly in accordance with the present invention.

Reference will now be made to the drawing figures to describe the present invention in detail.

Figure 2:
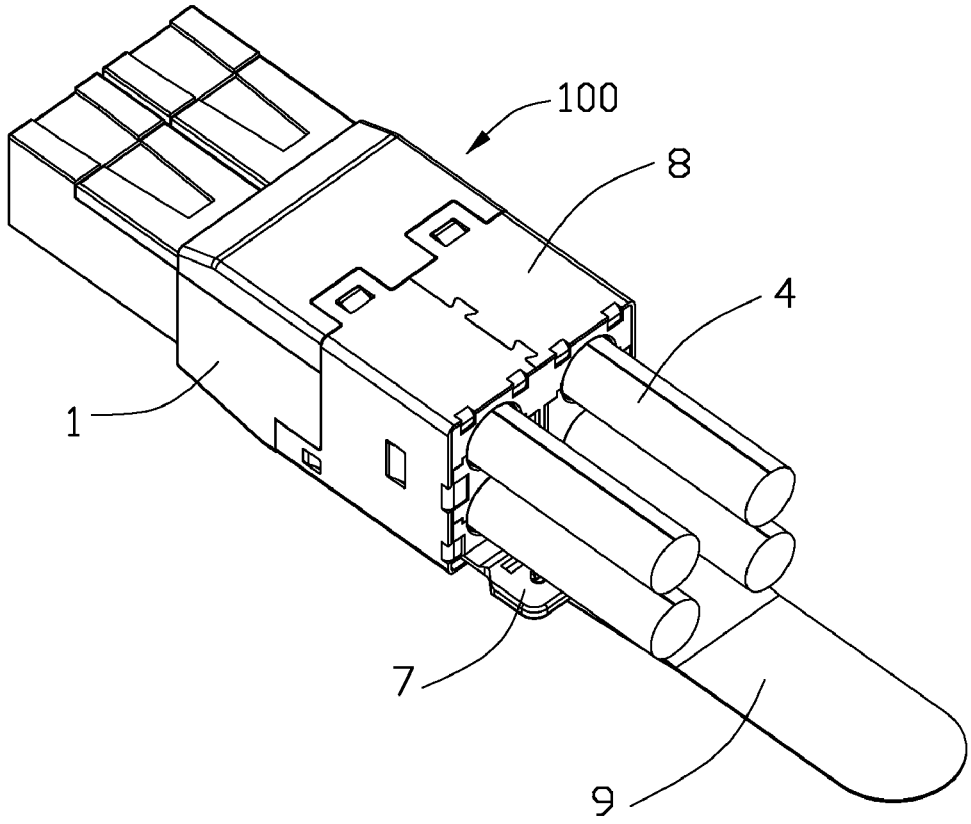
FIG. 2 is another perspective view of the electrical connector assembly of FIG. 1.

FIGS. 1 to 2 illustrate perspective views of an electrical connector assembly 100 made in accordance with the present invention. And in conjunction with FIGS. 6 to 9 and 12 to 13, the electrical connector assembly 100 comprises a housing 1 having two receiving rooms 11 formed therein, four paralleled printed circuit boards (PCBs) 2 received into two receiving rooms 11, two spacers 3 respectively disposed between two printed circuits boards 2 and engaged with the housing 1, four cables 4 respectively electrically connected with four printed circuit boards 2 and two strain reliefs 5 disposed in the housing 1 and respectively spaced apart with the two cables 4. The electrical connector assembly 100 further comprises a latch mechanism assembled to a top surface of the housing 1 and a metallic holder 8 surrounding a portion of the housing 1 and the latch mechanism. The latch mechanism comprises a latching member 6 and a pulling member 7 interconnected with each other.

Figure 3:
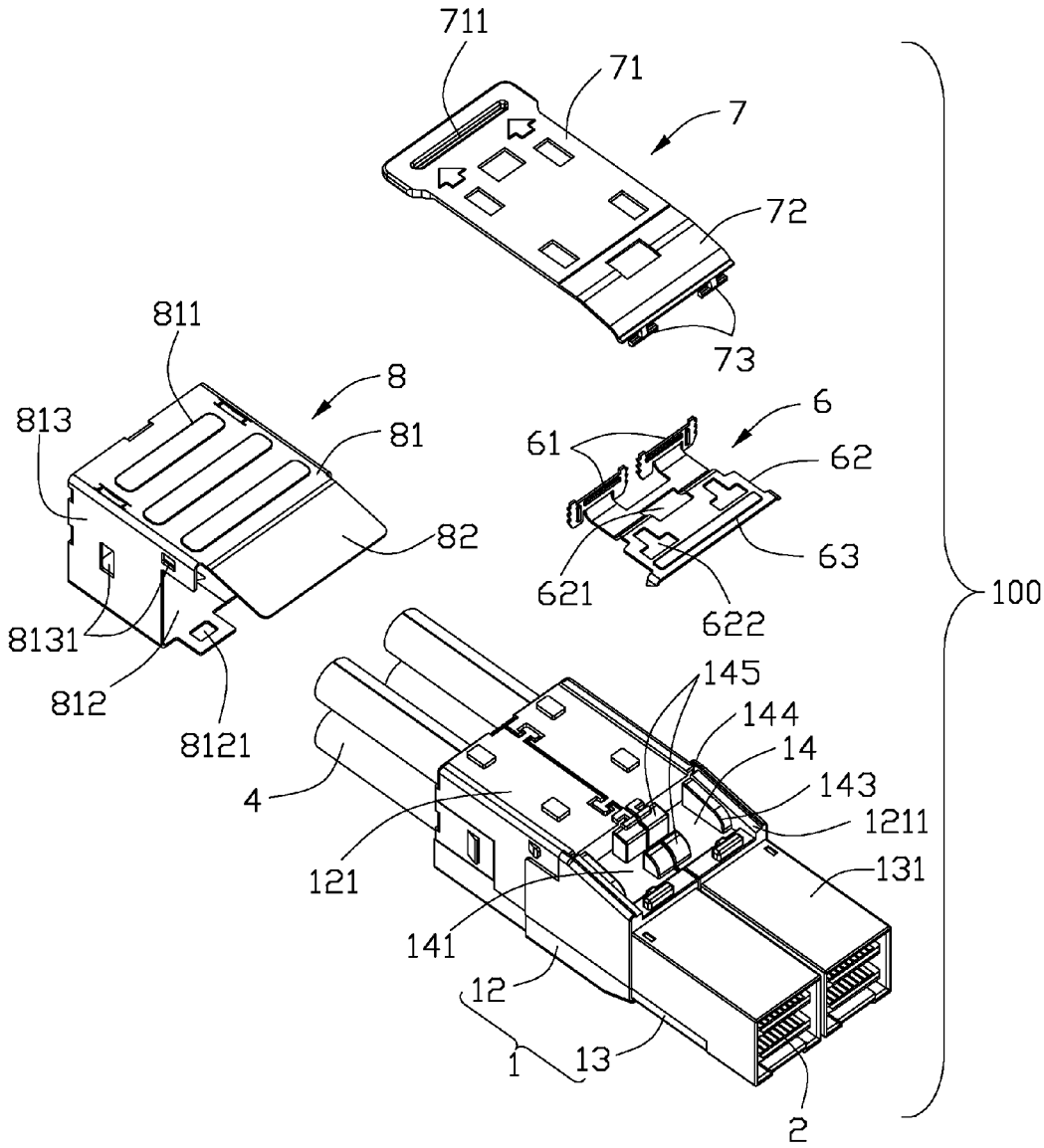
FIG. 3 is a partially assembled view of the electrical connector assembly of FIG. 1.
Figure 4:
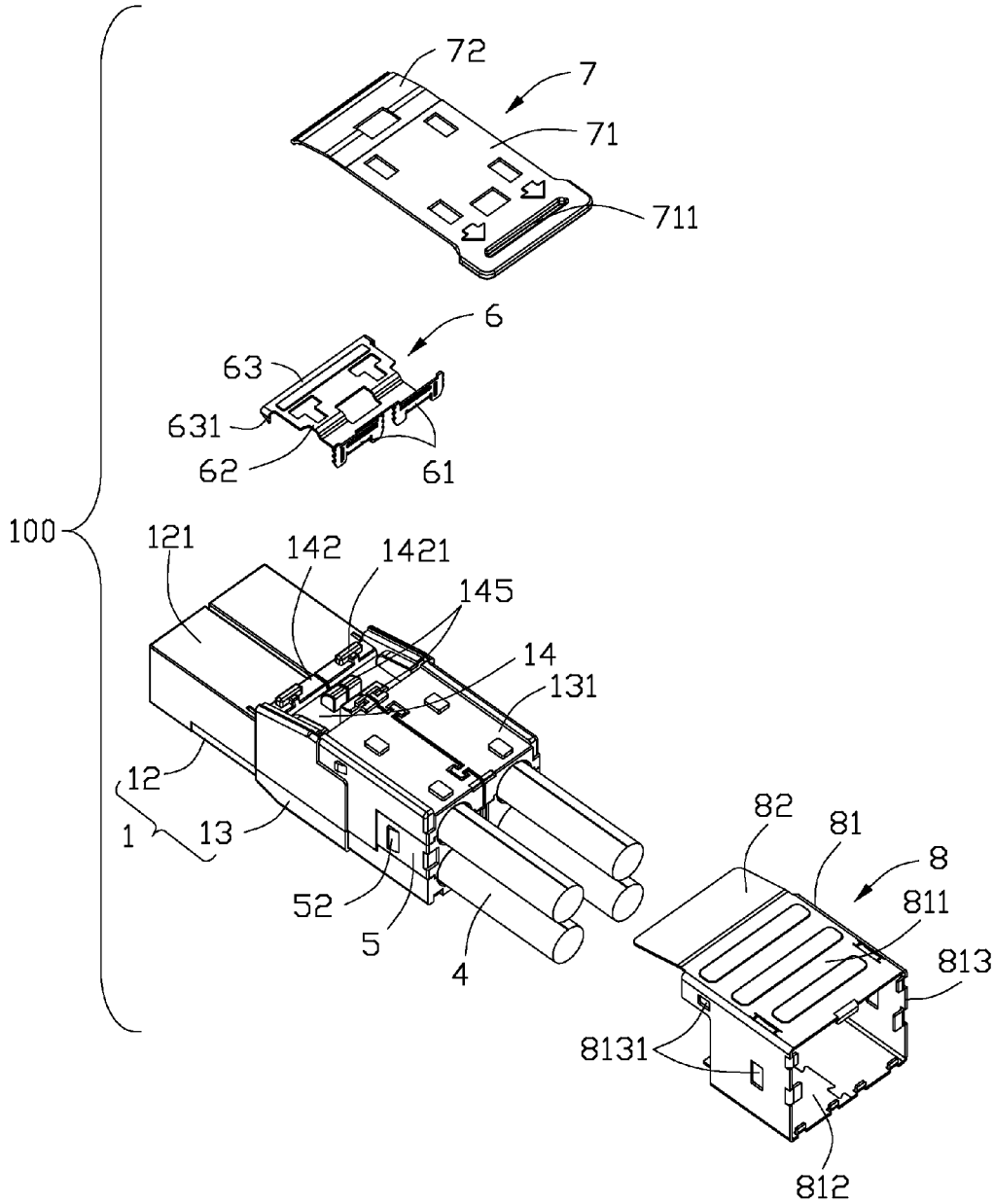
FIG. 4 is similar to FIG. 3, but viewed from another aspect.
Figure 5:
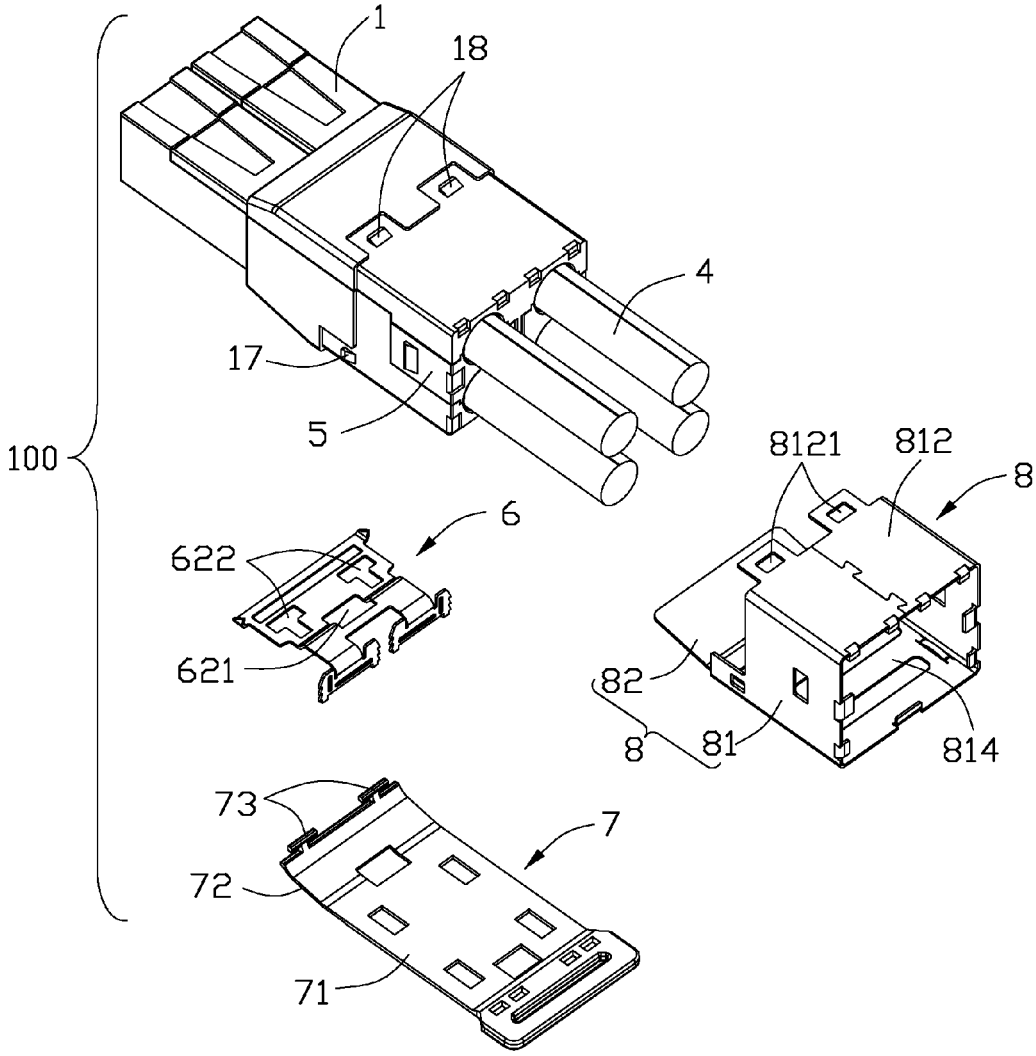
FIG. 5 is a partially assembled view of the electrical connector assembly of FIG. 2.

Referring to FIGS. 3 to 5, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The housing 1 defines two receiving rooms 11 formed therein and throughout the housing 1 along a front to rear direction. Two receiving rooms 11 are arranged side by side and spaced apart with each other. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface 1211 toward to the second surface 131. The body portion 12 defines a receiving cavity 14 extending downwardly from the inclined surface 1211 for a distance. The receiving cavity 14 has a bottom surface 141. A prominence 142 is formed in a front edge of the receiving cavity 14. Thus, the second surface 131 is separated to the bottom surface 141 along a front to rear direction. And, the prominence 142 further defines a pair of protrusions 142 formed on a top surface thereof. In addition, a pair of first supporting portions 143 are formed on two inner side surfaces of the receiving cavity 14 for supporting a front curving portion 72 of the pulling member 7. Each supporting portion 143 has a front arc top surface and a rear inclined top surface. Two spaced second supporting portions 145 are formed on a middle area of the receiving cavity 14 and arranged along a front-to-rear direction for supporting a front curving portion 72 of the pulling member 7. Two spaced slits 144 are respectively formed in back of the receiving cavity 14 and communicated with the receiving cavity 14. The housing 1 has a pair of wedge-shaped projections 17 respectively formed on two side surfaces thereof and a pair of wedge-shaped projections 18 formed on a bottom surface thereof.

Referring to FIGS. 6 to 9, the housing 1 comprises an upper shield part 15 and a lower shield part 16 assembled with each other. And, the upper shield part 15 is formed by a first shield part 151 and a second shield part 152. The first shield part 151 has a similar structure to the second shield part 152. The first and second shield parts 151 respectively has a rectangular port 1511, 1521. Two rectangular ports 1511, 1521 are defined as two spaced mating ports of the housing 1. The first and second shield parts 151, 152 respectively has a cutout 1512, 1522 formed on a bottom side thereof. Two cutouts 1512, 1522 are shielded by the lower shield part 16 when the first and second shield parts 151, 152 are assembled to the lower shield part 16 along an up-to-down direction. The first shield part 151 and second shield part 151 respectively defines two semi-circular first positioning posts 153 formed on each inner surface thereof for supporting a printed circuit board 2. Each of two first positioning posts 153 are spaced apart with each other and arranged along a front-to-rear direction. And, the first shield part 151 and the second shield part 152 respectively defines a second positioning post 154 formed between two first positioning posts 153 for limiting a front-to-rear movement of the printed circuit board 2. In addition, the first shield part 151 defines a first T-shaped positioning piece 1513 and a first T-shaped recess 1514 formed on a lateral surface thereof. The second shield part 152 also defines a second T-shaped positioning piece 1523 and a second T-shaped recess 1524. The first T-shaped positioning piece 1513 is cooperated with the second T-shape recess 1524. The second T-shaped positioning piece 1523 is cooperated with the first T-shaped recess 1514. The first shield part 151 defines a first cavity 1515 formed on a top surface thereof and communicated with an exterior. The second shield part 152 defines a second cavity 1525 formed on a top surface thereof and also communicated with an exterior. The receiving cavity 14 is formed by the first and second cavity 1515, 1525 when the first and second shield parts 151, 152 are assembled with each other. It should be noted that the pair of first supporting portions 143 are respectively formed in the first and second cavity 1515, 1525. Two wedge-shaped projections 17 are formed on two side surfaces of the upper shield part 15. Two wedge-shaped projections 18 are formed on a bottom surface of the lower shield part 16.

Figure 11:
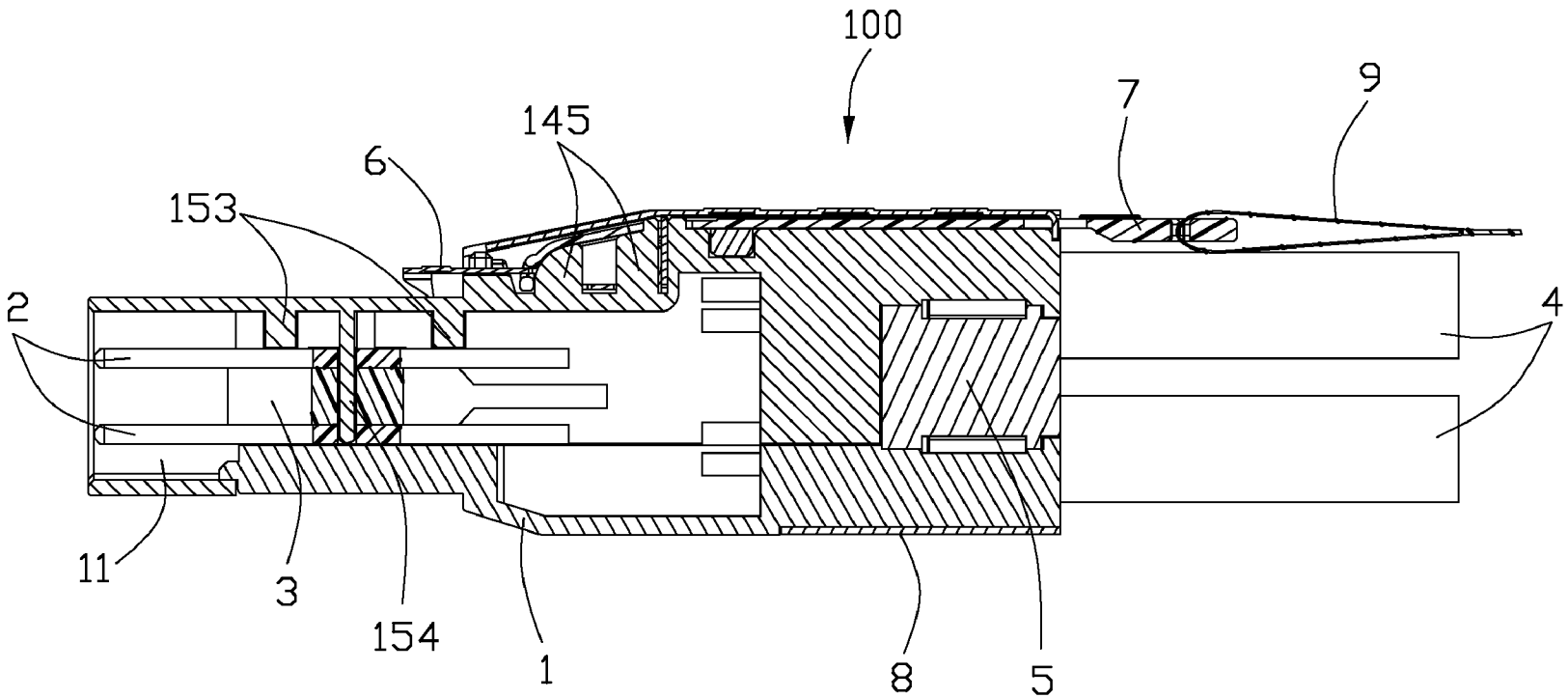
FIG. 11 is a cross section view of the electrical connector assembly of FIG. 1 taken along line 11-11.
Figure 12:
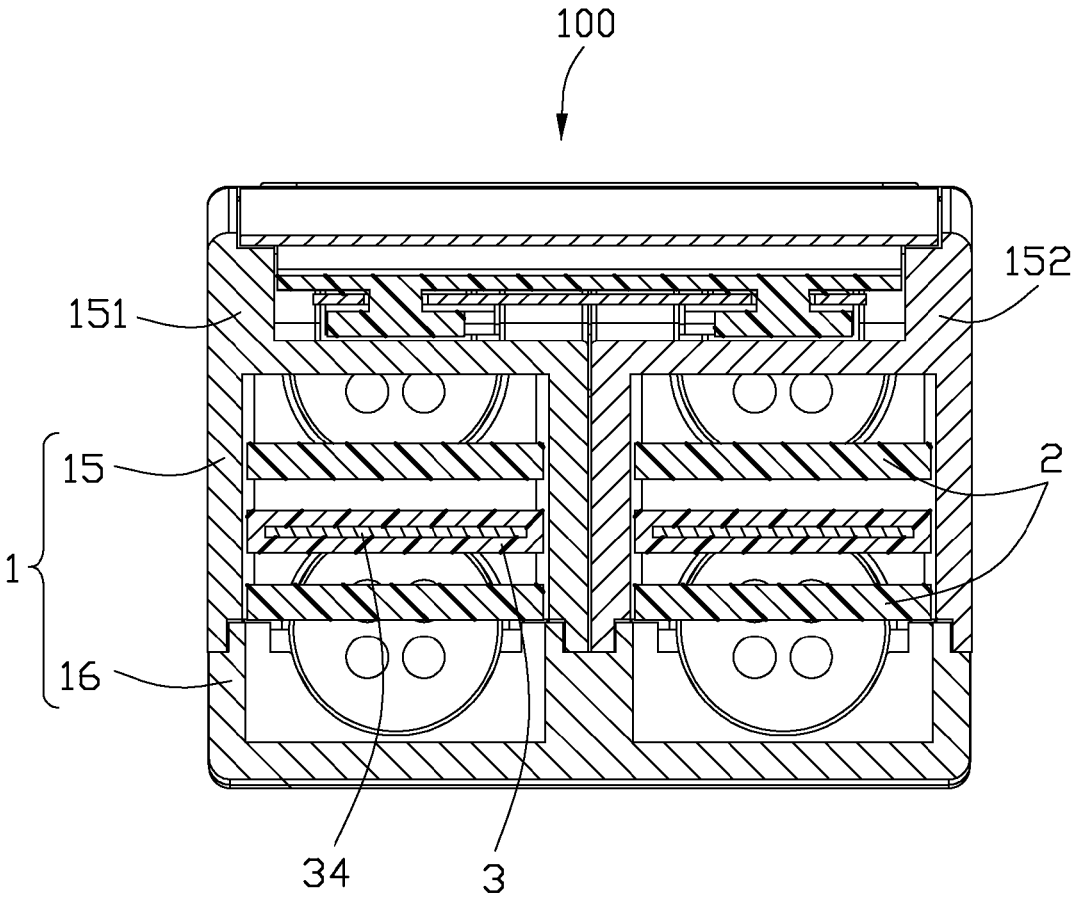
FIG. 12 is a cross section view of the electrical connector assembly of FIG. 1 taken along line 12-12.

Referring to FIGS. 6 to 9 and in conjunction with FIG. 11, four printed circuit boards 2 are disposed in the housing 1. Each of the printed circuit board 2 has a mating section 21 formed on a front end thereof and a terminating section 22 formed on a rear end thereof Each of the printed circuit board 2 defines a pair of slots 23 formed on two lateral sides for cooperating with the second positioning posts 154 of the upper shield part 15. Two printed circuit boards 2 are received into a receiving room 11. Another two printed circuit boards 2 are received into another receiving room 11.

Referring to FIGS. 6 to 13, two spacers 3 are formed of insulative material and respectively sandwiched between two printed circuit boards 2 in a vertical direction. Each of the spacer 3 defines a pair of ribs 31 formed on a top surface thereof and another pair of ribs 32 formed on a bottom surface for supporting the printed circuit boards 2. The spacer 3 further defines a pair of grooves 33 respectively formed on two sides thereof and extending along a vertical direction for cooperating with two corresponding second positioning posts 154 formed in a receiving room 11 of the upper shield part 15. The spacer 3 further defines a grounding plate 34 integrative formed therein.

Figure 6:
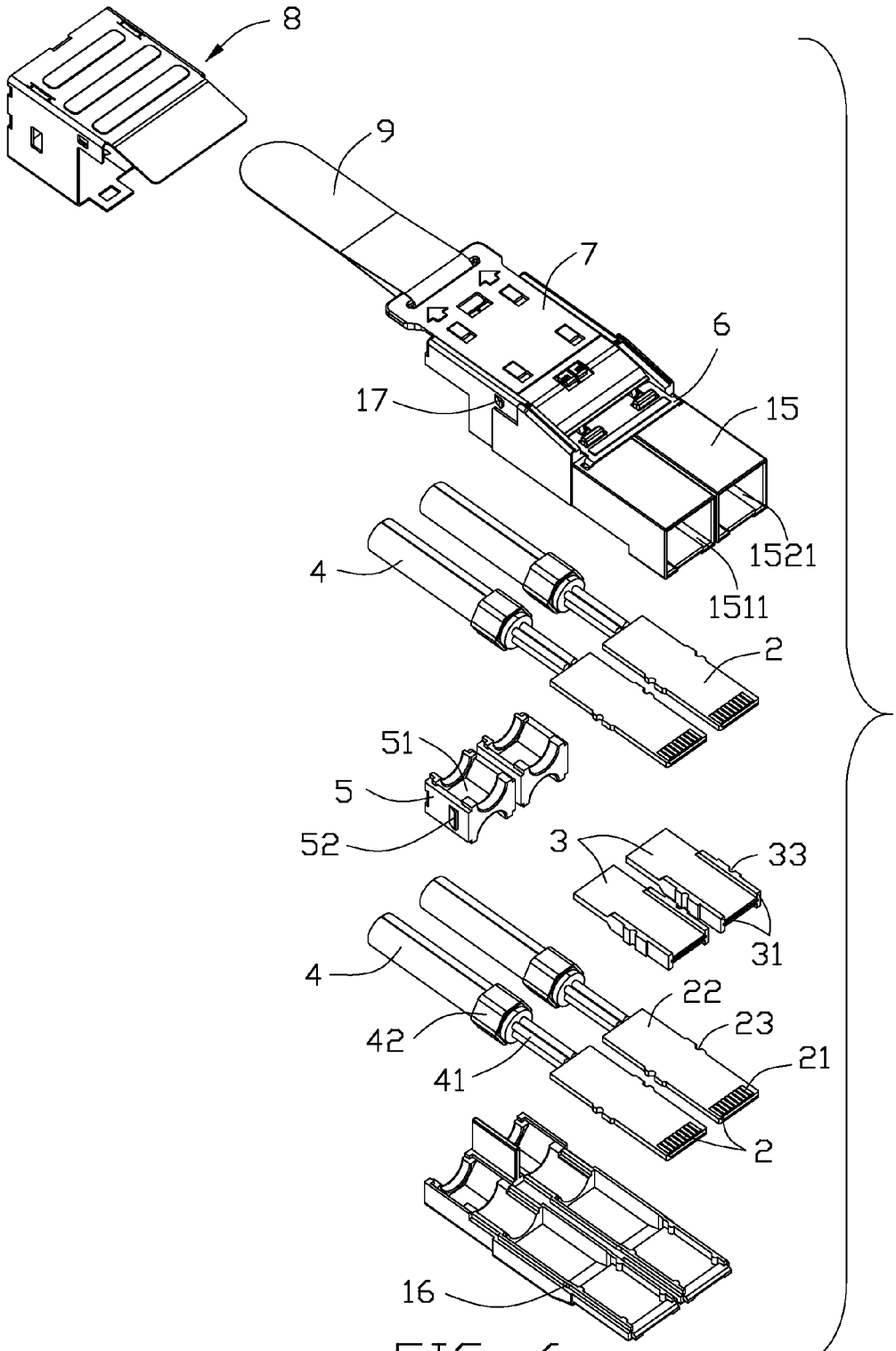
FIG. 6 is another partially assembled view of the electrical connector assembly of FIG. 1.
Figure 7:
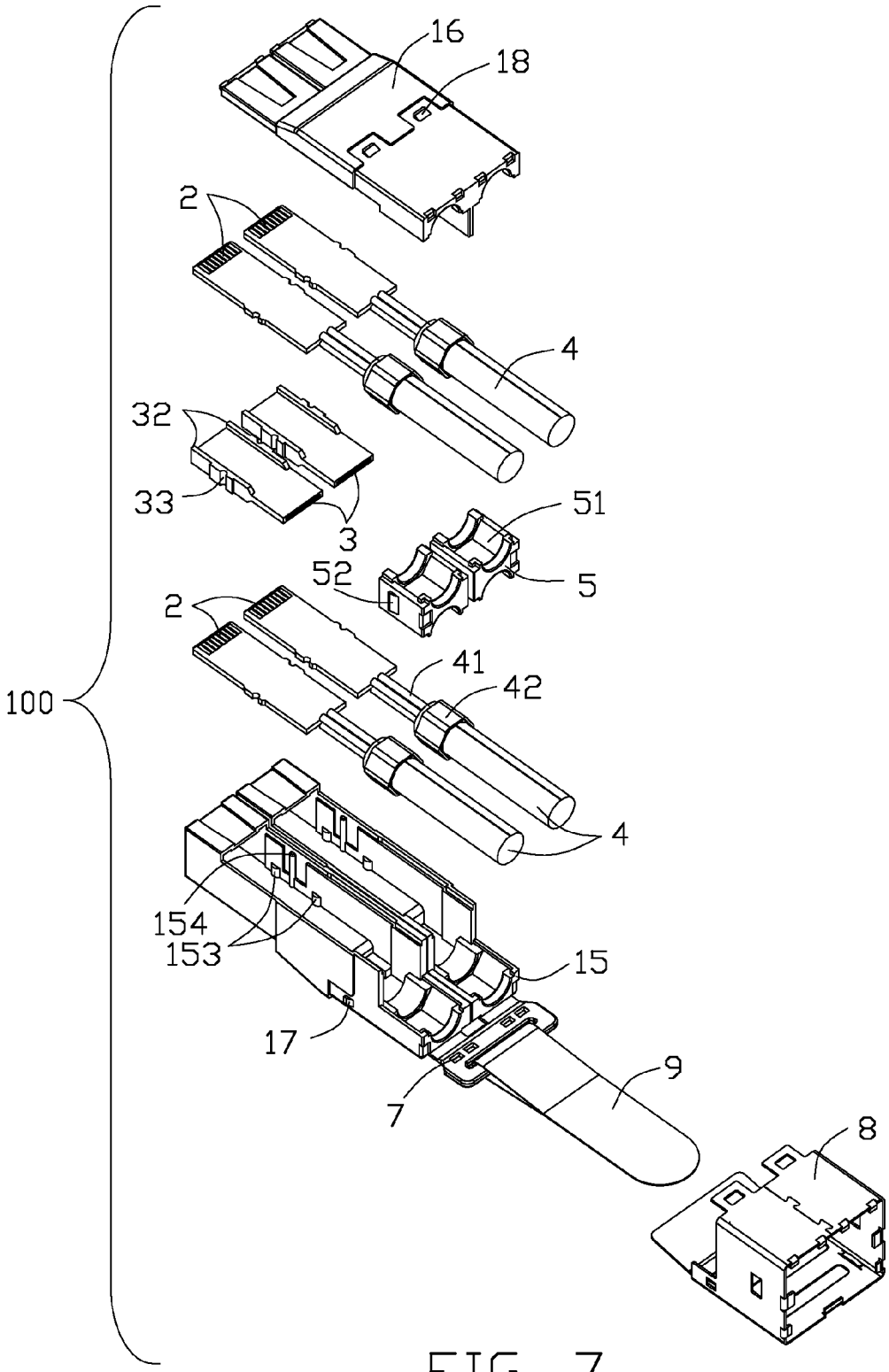
FIG. 7 is similar to FIG. 6, but viewed from another aspect.
Figure 8:
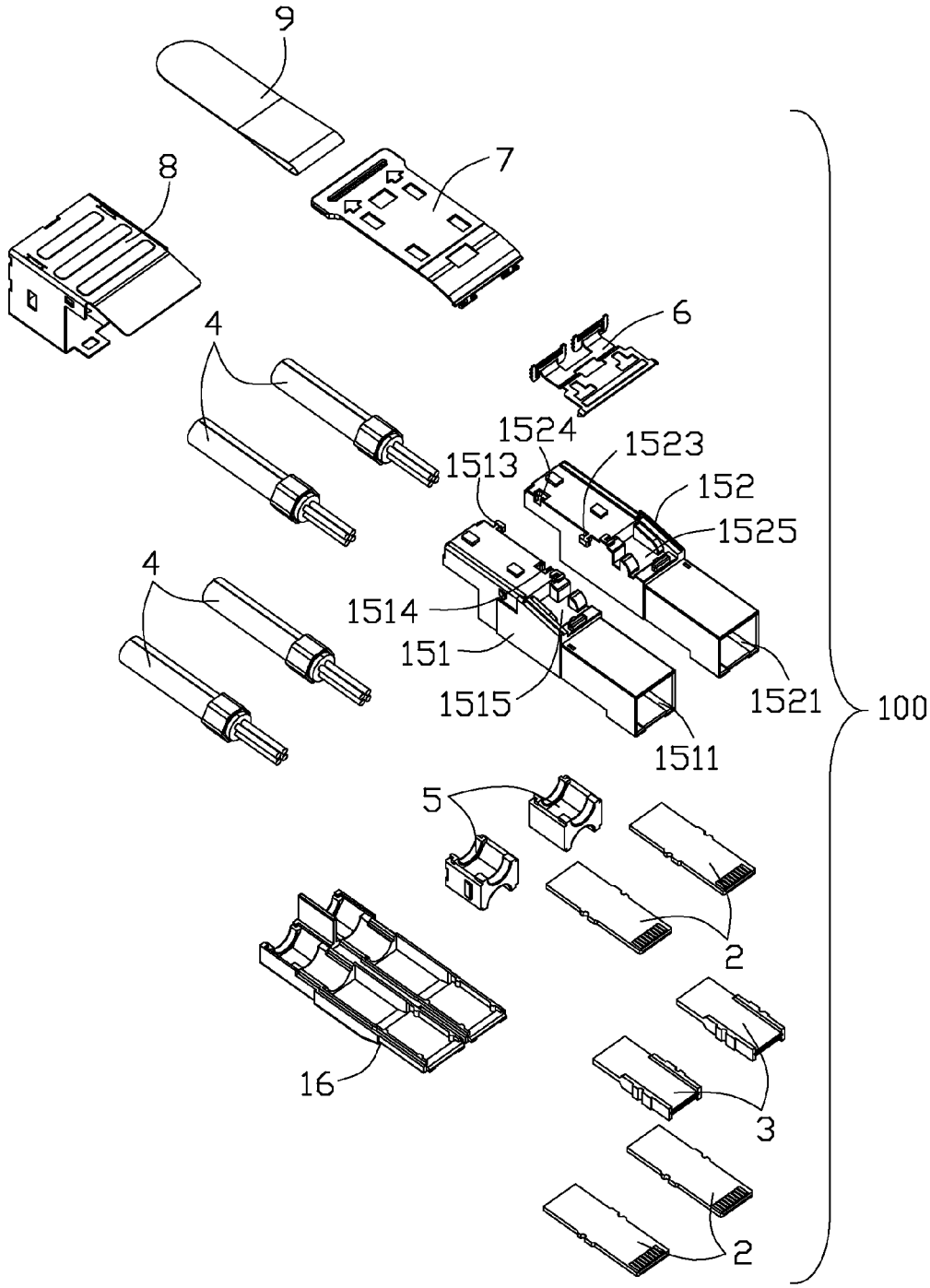
FIG. 8 is an exploded view of the electrical connector assembly of FIG. 1.
Figure 9:
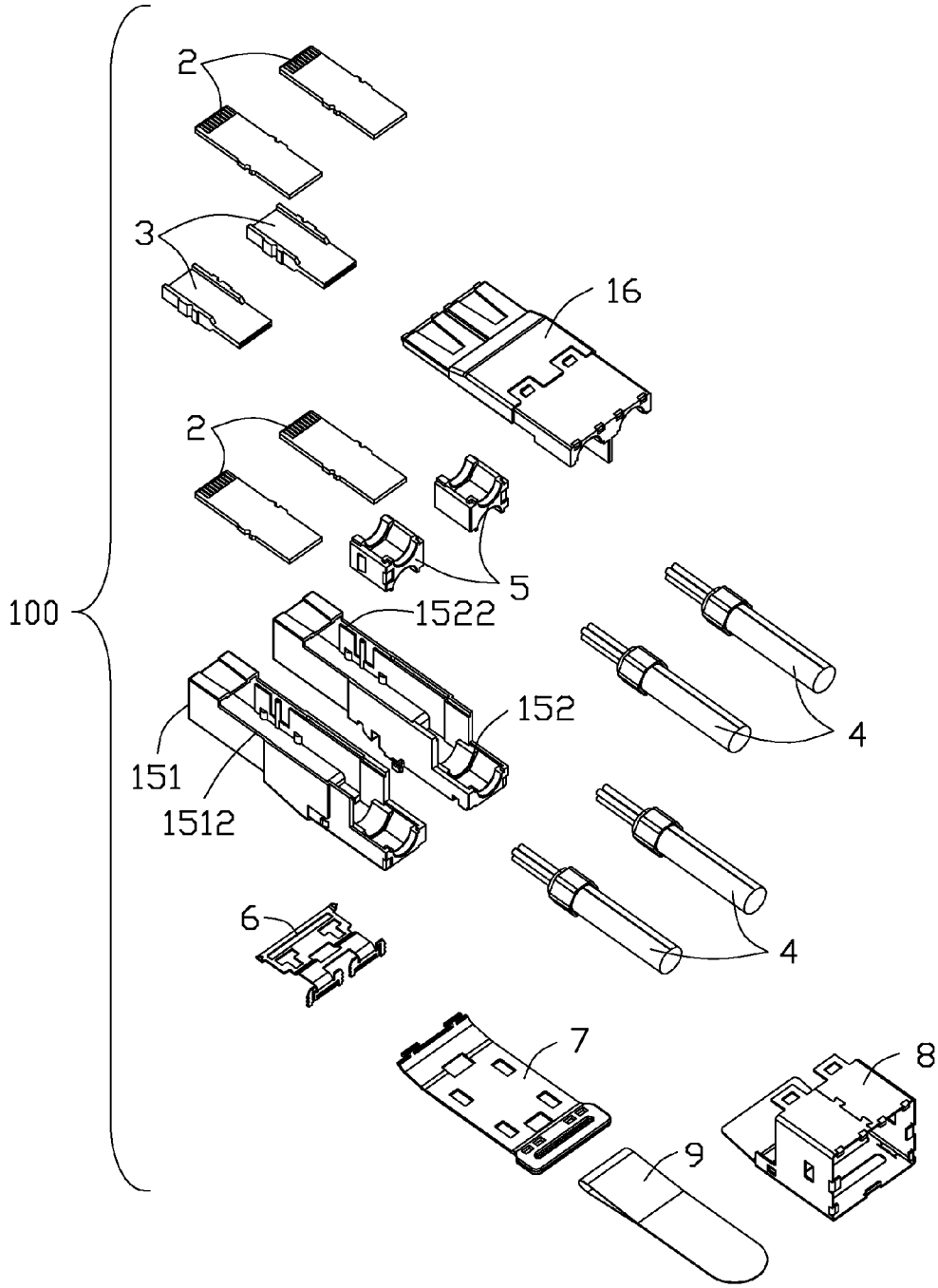
FIG. 9 is similar to FIG. 8, but viewed from another aspect.
Figure 10:
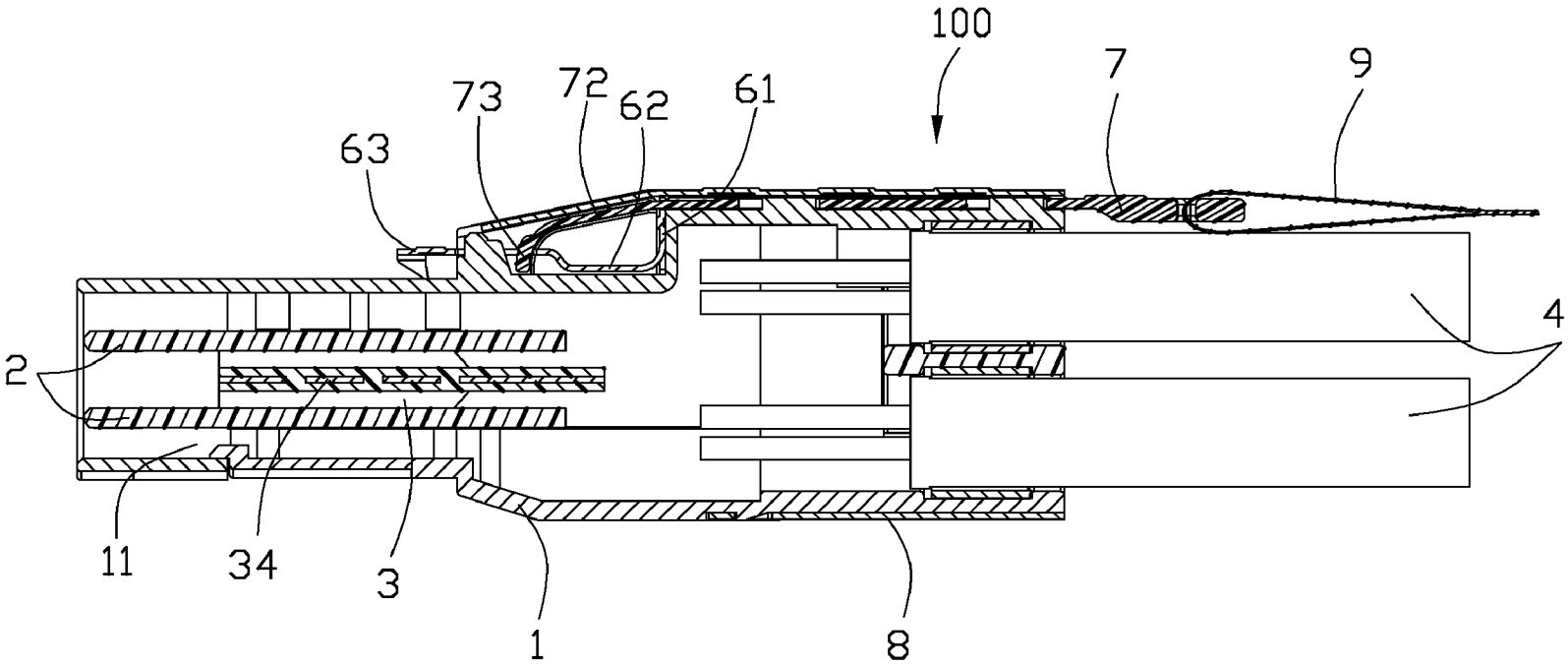
FIG. 10 is a cross section view of the electrical connector assembly of FIG. 1 taken along line 10-10.

Referring to FIGS. 6 to 7 and in conjunction with FIGS. 10 and 11, four cables 4 are respectively electrically and mechanically connected with four printed circuit boards 2. Each of the cable 4 has a plurality of conductors 41 formed therein and electrically connected to a terminating section 22 of the printed circuit board 2. A ring 42 is disposed at a front end of each cable 4 and surrounding a portion of the cable 4.

Figure 13:
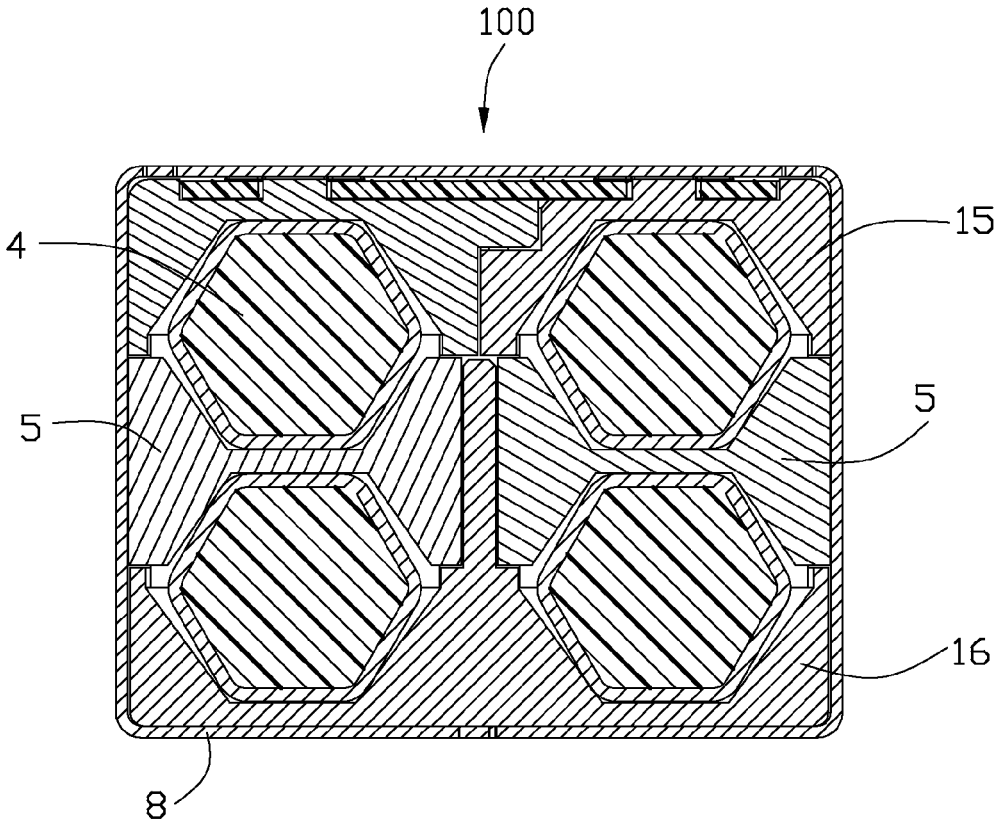
FIG. 13 is a cross section view of the electrical connector assembly of FIG. 1 taken along line 13-13.
Figure 14:
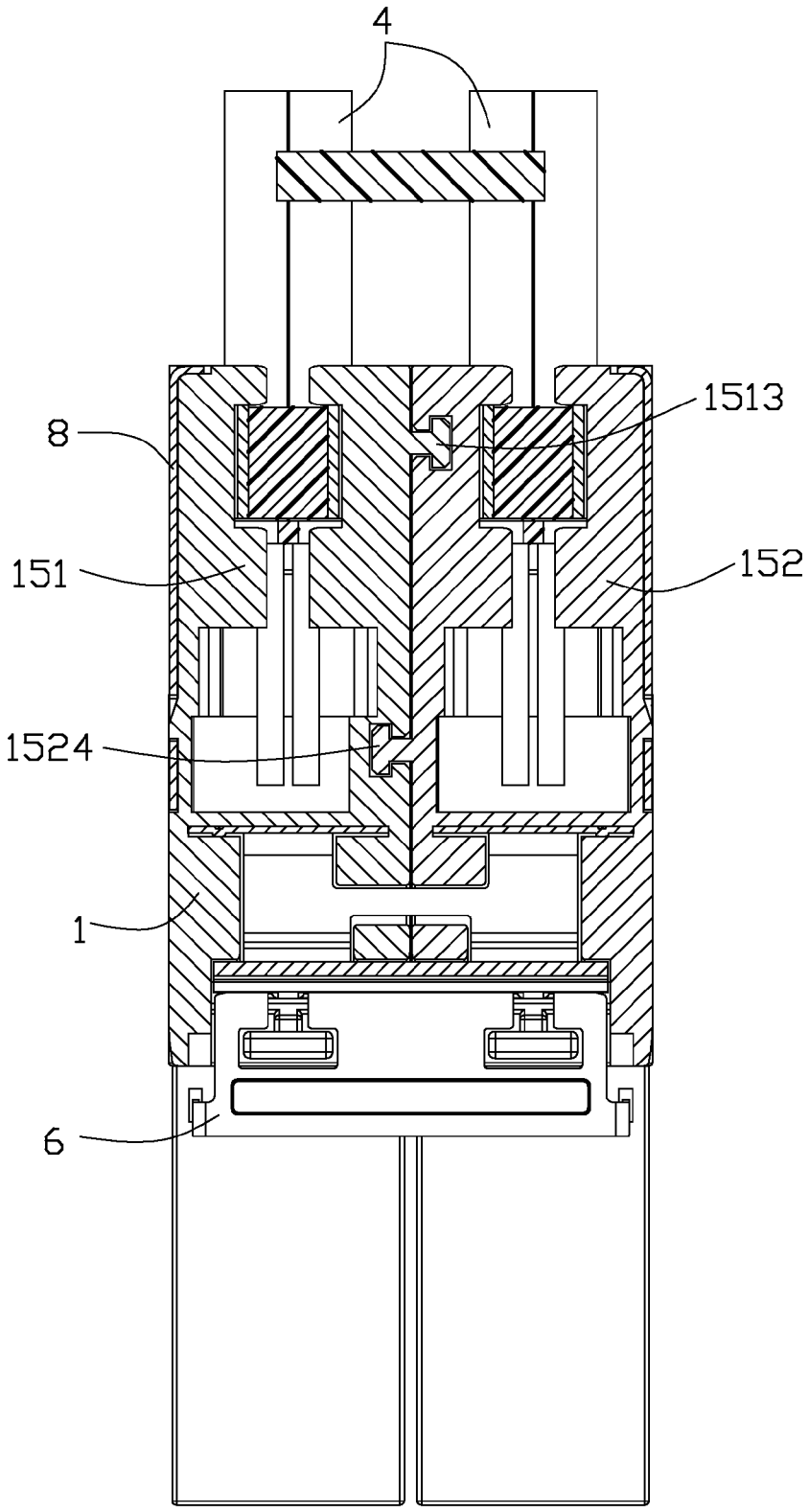
FIG. 14 is a cross section view of the electrical connector assembly of FIG. 1 taken along line 14-14.

Referring to FIGS. 6 to 9 and in conjunction with FIG. 13, two strain reliefs 5 are made of metallic material and respectively disposed in the two receiving rooms 11 of the housing 1. Each of the strain relief 5 is located on a rear area of the receiving room 11 of the housing 1 and has two recesses 51 respectively formed on a top and bottom surfaces thereof for receiving a portion of the ring 42. And, each of the strain relief 5 has a wedge-shaped projection 52 formed on a side surface thereof.

Referring to FIGS. 3 to 5 and in conjunction with FIG. 10, the latching member 6 is stamped and formed from a metallic plate and comprises two spaced vertical retaining portions 61, a connecting portion 62 extending forwardly from two bottom sides of the two retaining portions 61 and a latching portion 63 extending forwardly from the connecting portion 62. A front portion of the latch 6 is defined as a latching portion 63. The connecting portion 62 defines a rectangular opening 621 and two T-shaped openings 622 disposed in front of the rectangular opening 621. The latching portion 63 defines a pair of barbs 631 formed at two sides thereof.

Referring to FIGS. 3 to 5 and in conjunction with FIG. 10, the pulling member 7 is made of insulative material and structured in a flat shape. The pulling member 7 defines a horizontal section 71 and a curving section 72 extending forwardly and downwardly from the horizontal section 71. The pulling member 7 defines two T-shaped actuating sections 73 formed at a front free end thereof The pulling member 7 has a slit 711 formed a rear end of the horizontal section 71. A tape 9 is passed through the slit 711 and connected to the pulling member 7.

Referring to FIGS. 3 to 5 and in conjunction with FIG. 13, the metallic holder 8 defines a main portion 81 binding the upper shield part 15 and the lower shield part 16 and a shielding portion 82 extending forwardly from the main portion 81. The main portion 81 has a top wall 811, a bottom wall 812 and a pair of side walls 813 connected with the top wall 811 and the bottom wall 812. A receiving space 814 is formed by the top wall 811, the bottom wall 812 and the pair of side walls 813. The shielding portion 82 extends forwardly and downwardly from the top wall 811. Each of side wall 813 of the metallic holder 8 defines two positioning holes 8131 arranged along a front to rear direction. The bottom wall 812 also defines two positioning holes 8121.

Referring to FIGS. 1 to 14, the assembling process of the electrical connector assembly 100 made in according to the present invention starts from soldering the conductors 41 of each cable 4 respectively to the terminating section 22 of each printed circuit board 2.

After the four cables 4 are terminated to the four printed circuit boards 2, then assembling the first shield part 151 and the second shield part 152 together to form an upper shield part 15. Then, turning over the upper shield part 15 to make the two cutouts 1512, 1522 facing upward. Then, assembling a printed circuit board 2 into the first shield part 151 through the cutout 1512. The printed circuit board 2 is supported by the first positioning posts 153 of the first shield part 151 along a vertical direction. And, the printed circuit board 2 is engaged with the upper shield part 15 along a front-to-rear direction due to the pair of slots 23 of the printed circuit board 2 cooperated with the pair of second positioning posts 154 of the upper shield part 15. And, a front end of each cable 4 is supported by a rear end of the upper shield part 15.

After a cable 4 and a printed circuit board 2 are together assembled to the upper shield part 15, then assembling a strain relief 5 to a rear end of the first shield part 151. And, the ring 42 of the cable 4 is received into a room formed by the upper shield part 15 and the strain relief 5.

After the strain relief 5 is assembled to the first shield part 151, then assembling the spacer 3 to the first shield part 151. The spacer 3 is positioned with the first shield part 151 and located on the printed circuit board 2. The pair of second positioning posts 154 of the first shield part 151 pass through the corresponding two grooves 33 of the spacer 3 along an up-to-down direction to limit a movement of the spacer 3 along a front to rear direction.

After the spacer 3 is assembled to the first shield part 151, then assembling another printed circuit board 2 and cable 4 together to the first shield part 151 and located on the spacer 3. The printed circuit board 2 is engaged with the upper shield part 15 along a front-to-rear direction due to the pair of slots 23 of the printed circuit board 2 cooperated with the pair of second positioning posts 154 of the upper shield part 15. The ring 42 of the cable 4 has a portion received into a recess 51 of the strain relief 5. Through the above assembling steps, the two printed circuit boards 2, two cables 4, a strain relief 5 and a spacer 3 are assembled to the first shield part 151. According to the above assembling steps, another two printed circuit boards 2, two cables 4, a strain relief 5 and a spacer 3 are also assembled to the second shield part 152 through the cutout 1522.

Then assembling the lower shield part 16 to the upper shield part 15. Thus, the cutouts 1512, 1522 of the upper shield part 15 are shielded by the lower shield part 16 along an up-to-down direction. The printed circuit boards 2 are also positioned in the housing 1 by the lower shield part 16.

After the lower shield part 16 is assembled to the upper shield part 15, then assembling the latching member 6 to the pulling member 7 together through following steps. Firstly, the latching member 6 is disposed in front of pulling member 7 and arranged perpendicular to the pulling member 7. Secondly, the actuating section 73 of the pulling member 7 is passed through the T-shaped openings 622 the latching member 6 and located below the latching member 6. Thirdly, the latching member 6 is rotated 90 degree to make the latching member 6 and the pulling member 6 in line. Thus, the latching member 6 is interconnected with the pulling member 7. And, the latching member 6 is not easily discrete from the pulling member 7 due to the width of the actuating section 73 is wider than a width of a rear portion of the T-shaped opening 622.

Then, assembling the latching member 6 and the pulling member 7 together to an exterior surface of housing 1. The horizontal section 71 of the pulling member 7 is located on the first surface 121 of the body portion 12 of the housing 1. The curving section 72 of the pulling member 7 is supported by the first and second supporting portions 143, 145 formed in the receiving cavity 14. The rear end of the pulling member 7 extends rearwardly beyond the rear surface of the housing 1. In addition, the latching member 6 is received into the receiving cavity 14. Thus, the two retaining portions 61 are respectively disposed into the two slits 144 to make the latching member 6 engaged with the housing 1. The connecting portion 62 of the latching member 6 is located above the bottom surface 141 of the receiving cavity 14. The latching portion 63 extends forwardly and is located above the second surface 131 of the mating portion 13 of the housing 1. The latching portion 63 is cantilevered from the retaining portion 61. A tape 9 is passed through the slit 711 and connected to the pulling member 7. When a rearward pulling force is exerted on a rear end of the pulling member 7 or the tape 9, the latching portion 63 of the latching member 6 will be raised up. When the rearward pulling force is released, the latching portion 63 of the latching member 6 will resume to an original state.

Finally, assembling a metallic holder 8 to the housing 1. The main portion 81 of the metallic holder 8 binds the upper shield part 15, the lower shield part 16 and a portion of the pulling member 7 together. Two strain reliefs 5 are also surrounded by the main portion 81 of the metallic holder 8. The pulling member 7 can be moved along a front to rear direction relative to the housing 1 and limited by the metallic holder 8 along a vertical direction. Two positioning holes 8131 of the metallic holder 8 are cooperated with two wedge-shaped projections 17 of the upper shield part 151. Two positioning holes 8131 of the metallic holder 8 are cooperated with two wedge-shaped projections 52 of the strain relief 5. Two positioning holes 8121 are cooperated with two wedge-shaped projections 18 formed on a bottom surface of the lower shield part 16. Thus, the metallic holder 8 is firmly engaged with the housing 1 and two strain reliefs 5.

After the above assembling steps, the entire process of assembling of the electrical connector assembly 100 is finished. The electrical connector assembly 100 has a new mating surface to meet higher and higher data transmitting rate. On another aspect, a reliable latch mechanism is provided to an exterior surface of the housing. And, an easily and conveniently operating manner between the latching member 6 and the pulling member 7 is achieved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing having therein two receiving rooms extending along a front-to-rear direction and communicating with an exterior, the housing defining a body portion and a mating portion extending forward from the body portion;

a plurality of printed circuit boards received into two receiving rooms and positioned in the housing;

a latch mechanism assembled to an exterior surface of the housing; and a metallic holder surrounding and interlocked with the body portion of the housing and shielding a portion of the latch mechanism;

wherein the housing defines an upper shield part and a lower shield part assembled with each other along a vertical direction, and the upper shield part defines a first shield part and a second shield part engaged with each other along a horizontal direction.

2. The electrical connector assembly as recited in claim 1, wherein the electrical connector assembly further comprises two strain reliefs respectively disposed in two receiving rooms and interlocked with the metallic holder.

3. The electrical connector assembly as recited in claim 2, wherein the electrical connector assembly further comprises four cables extending into two receiving rooms and respectively electrically connected with four printed circuit boards.

4. The electrical connector assembly as recited in claim 1, wherein the electrical connector assembly further comprises a spacer disposed between the two printed circuit boards, and the spacer further defines a grounding plate integrally formed therein.

5. The electrical connector assembly as recited in claim 1, wherein the latch mechanism comprises a latching member and a pulling member interconnected with each other and respectively located on different surfaces of the housing, the pulling member is located on a higher surface, the latching member is located on a lower surface.

6. The electrical connector assembly as recited in claim 5, wherein the pulling member has two front actuating sections extending downwardly and passing through the latching member and located below the latching member, the latching member defines two spaced retaining portions engaged with the housing.

7. The electrical connector assembly as recited in claim 6, wherein the latching member is operated in a lever manner when the pulling member is moveable in a horizontal direction.

8. The electrical connector assembly as recited in claim 5, wherein the metallic holder defines a front shield portion shielding the front end of the pulling member and a rear end of the latching member.

9. The electrical connector assembly as recited in claim 5, wherein the pulling member defines a curving portion supported by a plurality of supporting portions formed on the lower surface.

10. An electrical connector assembly, comprising:

a pair of discrete metallic housings side by side arranged with each other, each of said housings having a body portion and a mating portion extending forwardly form the body portion, the mating portion communicating with an exterior;

a plurality of conductive contacts disposed in the housing;

a cable electrically connected with the conductive contacts; wherein each of said housings defines an opening communicating with the exterior in a transverse direction, which is perpendicular to an axial direction of the cable, for loading the conductive contacts into the body portion, and said openings of the pair of housings are covered by a common base under condition that said pair of housings define interengagement devices for assembling together, a metallic holder defines a main portion binding the pair of housings and the common base.

11. The electrical connector assembly as recited in claim 10, further including a latch mechanism assembled to exterior surfaces of the housings, and a metallic holder surrounding and engaged with the body portions, the metallic holder shielding a portion of the latch mechanism.

12. The electrical connector assembly as recited in claim 10, wherein the electrical connector assembly further comprises two strain reliefs sandwiched by the upper shield part and the lower shield part and engaged with the metallic holder.

13. The electrical connector assembly as recited in claim 10, wherein the interengagement devices are coupled to each other along the transverse direction.

14. The electrical connector assembly as recited in claim 10, wherein the latch mechanism defines a single latch section in a front area for mating with a complementary connector, and a pair of split retention sections in a rear area for respectively mounting to the corresponding housings.

15. An electrical connector assembly comprising:

a pair of discrete housings side by side positioned with each other, each of said housings defining a receiving cavity therein;

a pair of mating ports respectively formed in front portions of the receiving cavities in said pair of housings in a side by side arrangement along a transverse direction;

a plurality of contacting elements disposed in the mating ports and electrically connect to a plurality of cables correspondingly;

a unified latch mechanism disposed upon the housings and defining a unified latching section in a front area for latching a mating connector and a pair of split retention sections in a rear area for mounting the latch mechanism upon the housings, respectively; and a single pulling member having an actuation mechanism engaged with the unified latching section for operation.

16. The electrical connector assembly as claimed in claim 15, wherein a metallic holder protectively at least partially covers the pulling member and the latch mechanism.

17. The electrical connector assembly as claimed in claim 15, wherein the actuation mechanism includes a pair of actuators spaced from each other to respectively engage two spaced positions of the latching section for balanced operation.

18. The electrical connector assembly as claimed in claim 15, wherein each of said housings defines an opening in a transverse direction perpendicular to an axial direction of the cable for loading the corresponding contacting elements, and the openings of the pair of housings are covered by a common base.

19. The electrical connector assembly as claimed in clam 15, wherein each of said pair of the split retention sections defines two spaced barb areas respectively on two lateral sides, and is attached to the corresponding housing.

* * * * *